US012703919B2

(12) United States Patent
Schiftner et al.

(10) Patent No.: US 12,703,919 B2
(45) Date of Patent: Aug. 11, 2026

(54) YTTRIA-COATED REFRACTORY METAL COMPONENT

(71) Applicant: PLANSEE SE, Reutte (AT)

(72) Inventors: Robert Schiftner, Reutte (AT); Katrin Knittl, Reutte (AT); Thomas Huber, Reutte (AT); Michael Mark, Reutte (AT)

(73) Assignee: Plansee SE, Reutte (AT)

( * ) Notice: Subject to any disclaimer, the term of this patent is extended or adjusted under 35 U.S.C. 154(b) by 121 days.

(21) Appl. No.: 18/257,646

(22) PCT Filed: Nov. 25, 2021

(86) PCT No.: PCT/AT2021/060447
§ 371 (c)(1),
(2) Date: Jun. 15, 2023

(87) PCT Pub. No.: WO2022/126158
PCT Pub. Date: Jun. 23, 2022

(65) Prior Publication Data

US 2024/0117496 A1 Apr. 11, 2024

(30) Foreign Application Priority Data

Dec. 15, 2020 (AT) ..... GM50251/2020

(51) Int. Cl.
*C23C 24/00* (2006.01)

(52) U.S. Cl.
CPC ..... *C23C 24/00* (2013.01)

(58) Field of Classification Search
CPC ..... C23C 8/40
USPC ..... 428/469
See application file for complete search history.

(56) References Cited

U.S. PATENT DOCUMENTS

| | | | |
|---|---|---|---|
| 5,769,918 A | 6/1998 | Burt et al. | |
| 6,753,650 B2 | 6/2004 | Leichfried et al. | |
| 2002/0033079 A1 | 3/2002 | Zurbuchen et al. | |
| 2003/0017338 A1* | 1/2003 | Takai | C23C 30/00 428/408 |
| 2004/0166359 A1* | 8/2004 | Fukaya | C23C 4/10 428/615 |
| 2007/0046168 A1 | 3/2007 | Becker et al. | |
| 2009/0142732 A1 | 6/2009 | Kahdemann et al. | |
| 2013/0004261 A1 | 1/2013 | Pattinson et al. | |

FOREIGN PATENT DOCUMENTS

| | | | |
|---|---|---|---|
| AT | 4408 | U1 | 6/2001 |
| CN | 201874952 | U | 6/2011 |
| CN | 108585897 | A | 9/2018 |
| CN | 109277518 | A | 1/2019 |
| CN | 109750289 | A | 5/2019 |
| DE | 10214998 | A1 | 11/2002 |
| DE | 102006038821 | A1 | 3/2007 |
| DE | 102013213503 | A1 | 8/2014 |
| GB | 2294040 | A | 4/1996 |
| JP | 2000129346 | A | 5/2000 |
| JP | 2004281392 | A | 10/2004 |
| JP | 2008095161 | A | 4/2008 |
| JP | 2009506812 | A | 2/2009 |
| WO | 9320026 | A1 | 10/1993 |
| WO | 9936593 | A1 | 7/1999 |
| WO | 2008138026 | A1 | 11/2008 |
| WO | 2021122308 | A1 | 6/2021 |

OTHER PUBLICATIONS

Defense Metals Information Center, "Summary of the Second and Third Briefings on Refractory Metal Alloy Structural Fasteners", Oct. 8, 1962, URL: <https://books.google.com/books?hl=en&lr=&id=9orviGOdo7YC&oi=fnd&pg=PA1&dq#v=onepage&q&f=false>, pp. 1-37 (Year: 1962).*

Fukaya et al., JP 2004281392 A Google Patents machine translation printed Nov. 27, 2025, Oct. 7, 2004, entire translation (Year: 2004).*

* cited by examiner

*Primary Examiner* — Katherine A Christy
(74) *Attorney, Agent, or Firm* — Laurence A. Greenberg; Werner H. Stemer; Ralph E. Locher

(57) ABSTRACT

A component formed of a refractory metal has a surface that is at least partially coated with a layer of yttria. There is also described a method of manufacturing a coated component, and the application of $Y_2O_3$ as a release agent in high temperature applications.

6 Claims, No Drawings

YTTRIA-COATED REFRACTORY METAL COMPONENT

FIELD AND BACKGROUND OF THE INVENTION

The present invention relates to a component comprising a refractory metal, characterized in that the surface of the component is at least partially coated with a layer of $Y_2O_3$.

The invention further relates to the manufacture of the coated component and the use of $Y_2O_3$ as a release agent in high temperature applications.

In high-temperature plants, such as sintering furnaces, heat treatment plants and a quartz melting plants, or also in lighting plants and evaporation plants, there is the use of components which must be detachable even after repeated exposure to temperature and stress. The detachability of such components after exposure to high temperatures in the range of 1000° C. to 1400° C. presents a particular challenge, since the typically metal-fabricated components tend to sinter on their contact surface with the mating contact surface, the phenomenon of seizing. If the contact surfaces are additionally subjected to pressure, as in the case of a screw connection, for example, the metallurgical bonding of the contact surface pairs is further promoted. Thereafter, the contact surface pairs can no longer be separated from each other without causing damage and the separation causes the destruction of at least one component.

To avoid this problem, various material combinations or auxiliaries and separating agents, such as sleeves or applied separating layers of pastes, are used. However, these methods quickly reach their limits under extreme conditions. For example, some auxiliaries and release agents cannot be used in a vacuum due to the risk of evaporation of their components and/or their operating temperature is limited due to decomposition. Currently, $Al_2O_3$, $ZrO_2$ or boron nitride sprays or powders are used for application in furnace construction. However, these variants are unsuitable for applications with temperatures around 1400° C., since in particular cross-contamination between components and the auxiliary and release agent is a problem.

In the production of coarse-grained, creep-resistant molybdenum charging sheets, recrystallization annealing at temperatures of 1700° C. to 1900° C. is necessary, whereby sheets partially sinter in the stack and are therefore no longer separable after the annealing run. Until now, tungsten thin sheet has been used as a separation aid. However, the disadvantage is that the tungsten thin sheets can only be used once and thus contribute significantly to the high manufacturing costs of charging sheets.

DE 102013213503 relates to a threaded connection for vacuum applications comprising a screw with external threads and a component with internal nut threads, wherein either the component or the screw or both are formed from a stainless austenitic steel, wherein different pairs of contact surfaces are created by coating the component/screw with coating materials different from the base materials, allowing mutual sliding without lubricants harmful to vacuum.

In GB201110939, there is provided a first member suitable for selectively engaging a second member, the first member comprising a coating and at least an engaging portion of the first member being coated in the coating, the coating being formed by vapor deposition to provide a thermochemically stable layer for temperatures up to 800° C. The coating may comprise one or more nitrides, oxides, or carbides of titanium, chromium, or aluminum. For example, the coating may comprise one or more titanium nitride, chromium nitride, aluminum nitride, titanium oxide, chromium oxide, aluminum oxide, titanium carbide, chromium carbide, or aluminum carbide.

In the field of high-temperature treatments, the use of particularly high temperatures of 1400° C. to 1900° C. is increasingly required. At the same time, increasingly stringent requirements are laid down on the purity of the treated products.

SUMMARY OF THE INVENTION

Accordingly, the object of the present invention is to provide a coated component which is detachable even after use at temperatures in the range from 1000° C. to 1400° C., in particular up to 1900° C., wherein no cross-contamination with other components or treated products occurs.

This object is solved by providing a component as claimed, consisting of a refractory metal, the surface of which is at least partially coated with a layer of $Y_2O_3$, its production as well as the use of $Y_2O_3$ as a separator agent in high temperature applications. Advantageous embodiments of the invention are the subject of the dependent claims, which can be freely combined with each other.

The use of a layer of $Y_2O_3$ allows the components to be used in different atmospheres, such as hydrogen or in a vacuum, without the risk of cross-contamination or a decomposition. The application of these layers also ensures the non-destructive replacement and non-destructive opening of components, respectively. Sintering of component parts can thus be prevented and it can hence be ensured that they remain detachable. With the $Y_2O_3$ layer in particular a temperature application range of 1000° C. to 1400° C., in particular up to 1900° C. can be covered without risk of pollution/contamination or seizing, and the detachability of the components/machine elements can be achieved.

According to the present invention, a connection is detachable if surfaces of components that are in direct contact with each other can be separated from each other again without damaging the components, and it is not detachable if the components have to be at least partially destroyed in order to separate the contacting surfaces from each other again.

The coated component according to the invention is particularly suitable for high-temperature applications, i.e. for applications with temperatures in the range from 1000° C. to 2000° C., presently in particular 1400° C. to 1900° C.

To withstand these temperatures, the component of the present invention consists of a refractory metal.

In the context of the present invention, a refractory metal is understood to be a metal selected from the group consisting of titanium, zirconium, hafnium, vanadium, niobium, tantalum, chromium, molybdenum, tungsten and rhenium and alloys of said metals, also referred to herein as refractory metal alloys. Refractory metal alloys are alloys with at least 50 at. % of one or more of the above-mentioned metals, preferably with at least 70 at. %, further preferred with at least 90 at. % and even more preferably with at least 95 at. %.

It is understood that the melting point of the refractory metal defined above is selected so that the component is suitable for the temperature targeted in use. Preferably, the refractory metal has a melting point greater than 1400° C., more preferably greater than 1800° C., and more preferably greater than 2000° C.

In one embodiment, the component comprises molybdenum, besides unavoidable impurities, or a molybdenum alloy.

In one embodiment, it is further preferred that the alloy comprises, in addition to molybdenum, up to 30% by weight of further of the above-mentioned refractory metal elements.

In a further embodiment, it is preferred that compositions consist, in addition to molybdenum, of the following percentages of elements by weight:

0.5 wt % Ti and 0.08 wt % Zr and 0.01 wt % to 0.04 wt % C. 1.2 wt % Hf and 0.01 wt % to 0.04 wt % C. 0.3 wt % $La_2O_3$. 0.7 wt. % $La_2O_3$. 0.47 wt. % $Y_2O_3$ and 0.08 $Ce_2O_3$. 0.005 to 0.1 wt. % K and 0.005 wt. % to 0.1 wt. % Si and 0.01 to 0.2 wt. % 0.5 wt. % Re or 41 wt. % Re. 30 wt. % W. Furthermore, compositions are also included in which the proportions given here differ by up to 10%.

The proportions given and the data refer to the element referred to in each case (e.g., Mo, C or W), irrespective of whether it is present in the molybdenum base material in elemental or bound form. The proportions of the various elements are determined by chemical analysis.

The term component in the sense of the present invention includes individual parts (machine elements, components), in particular construction means which are suitable for the exchange or reversible fastening and loosening of machine elements, as well as assemblies composed of individual parts. Suitable components are in particular screws, nuts, pins, locating pins, washers, bolts, sheets, clips, tubes, rods and U-rails. As assemblies, mention may be made in particular of welded and riveted components, such as gas inlet tubes, heater suspensions and charging racks. The term components as a used in the present invention specifically excludes cutting parts of cutting tools.

Preferred components as production aids are contact parts, such as separator sheets and washers. In particular, separator sheets are preferred.

In addition, preferred components as production aids are components that have a thread, such as a screw or a nut. A screw is particularly preferred.

According to the invention, the coating of the component consists of $Y_2O_3$. The $Y_2O_3$ coating is typically applied to the component by brushing, spraying, printing or dipping of a $Y_2O_3$ suspension and subsequently drying. Preferably, the $Y_2O_3$ suspension is an ethanol-based suspension.

Preferably, the $Y_2O_3$ suspension is sintered onto the component in a hydrogen atmosphere at about 1800° C. for a period of 2 to 6 h. This improves the initial layer adhesion.

The coated components have a $Y_2O_3$ layer with a thickness in a range from 10 μm to 150 μm, preferably 20 μm to 110 μm, more preferably 40 μm to 80 μm and further preferably 50 μm to 70 μm. The thickness of the layer can be determined by lateral SEM measurement of a transverse section of the coated component. The component typically does not have any other layers of other materials. If other layers are present, for example to provide adhesion, the $Y_2O_3$ layer is the outermost layer of the coated component.

Typically, the layer is completely applied to the coated component's surface which is to be contacted with further components. In order to achieve improved detachability of the components, it is already sufficient if the layer is only partially applied to the coated component's surface which is to be contacted with further components.

Preferably, 20 to 100% of the coated component's surface which is to be contacted with a further component is coated with the layer, further preferably 50 to 100%.

The present invention can be used wherever good releasability of a component from a another component is required after the component has been used in high temperature applications. Accordingly, the use of $Y_2O_3$ as a release agent to improve the releasability of components for high temperature applications is also subject-matter of the present invention. Preferably, the yttria is used in the form of a layer applied by means of slurry coating, preferably on a component consisting of a refractory metal.

Further advantages of the invention will be apparent from the following description of examples of embodiments.

EXAMPLE 1: SCREW CONNECTION

TZM plate (molybdenum with a weight fraction of 0.5 Ti and 0.08 Zr as well as 0.01 to 0.04 C) 140×80×9 mm, 9 mm deep through bore milled with M6 thread Molybdenum washer: 18×6, 4×1.5 mm Molybdenum screw: M6×12 mm Several screws were coated by slurry coating with a $Y_2O_3$— (according to the invention), $ZrO_2$—, TaC— or ZrC— suspension and then dried. The coatings had a thickness in the range of 50 to 70 μm.

As indicated in the table below, several tests were conducted to evaluate the $Y_2O_3$ coating versus the comparative coatings under different conditions. For this purpose, three screws (S1 to S3) with washers were selected in each case and screwed into the plate at a tightening torque of 12 Nm. High temperature treatments were performed at temperatures (T (in ° C.)) ranging from 400° C. to 1400° C. and different atmospheres (A) (hydrogen (H), vacuum $10^{-6}$ mbar (V)) with a holding time of 2 h. The opening torque (L (in Nm)) was measured after the high temperature treatment and the threads were visually inspected for seizing (S) and, if applicable, breakage (B) of the screw was detected.

| | | | S1 | | | S2 | | | S3 | | | Total | | |
|---|---|---|---|---|---|---|---|---|---|---|---|---|---|---|
| Layer | T | A | L | S | B | L | S | B | L | S | B | L | S | B |
| $Y_2O_3$ | 400 | V | 0 | no | no | 0 | no | no | 0 | no | no | lower | no | no |
| Slurry | 1000 | V | 5 | no | no | 5 | no | no | 5 | no | no | lower | no | no |
| | 1400 | V | 5 | no | no | 5 | no | no | 10 | yes | yes | lower | partly | partly |
| | 1400 | H | <5 | no | no | <5 | no | no | <5 | no | no | lower | no | no |
| $ZrO_2$ | 400 | V | 15 | yes | no | 15 | yes | no | 15 | yes | no | similar | yes | no |
| Slurry | 1000 | V | 10 | yes | no | 10 | yes | no | 10 | yes | no | similar | yes | no |
| | 1400 | V | 12 | yes | no | 10 | yes | no | 10 | yes | no | similar | yes | no |
| | 1400 | H | 10 | yes | no | 10 | yes | no | 10 | yes | no | similar | yes | no |
| TaC | 400 | V | 15 | yes | no | 15 | yes | no | 15 | yes | no | similar | yes | no |
| Slurry | 1000 | V | 10 | yes | no | 10 | yes | no | 10 | yes | no | similar | yes | no |
| | 1400 | H | 10 | yes | no | 10 | yes | no | 10 | yes | no | similar | yes | no |
| ZrC | 400 | V | 10 | no | no | 10 | no | no | 10 | no | no | similar | no | no |
| Slurry | 1000 | V | 5 | yes | no | 5 | yes | no | 5 | yes | no | lower | yes | no |
| | 1400 | H | 10 | yes | no | 10 | yes | no | 10 | yes | no | similar | yes | no |

As can be seen from the above table, the $ZrO_2$ and TaC coated screws already show seizing at low temperatures as of 400° C. and are therefore unsuitable for high-temperature applications. The ZrC-coated screws show seizing above 1000° C. and are therefore also unsuitable for high-temperature applications.

In contrast, with the $Y_2O_3$ coating according to the invention, no seizing of the screw connection occurs. Consequently, the coating can achieve the detachability of contacting refractory metal components. In addition, no cross-contamination between the components could be detected.

EXAMPLE 2: PRODUCTION AND EVALUATION OF COATED RELEASE SHEETS

Various products were tested and evaluated as possible release agents for stack annealing of sheets. For this purpose, the different release agents were applied between the sheets. The sprays or suspensions were applied on one side of 1 mm thick molybdenum sheets (area about 40×20 mm). The applied layers had a thickness between 50 and 70 μm. 25 sheets were annealed in a stack at 1900° C. for one hour in a hydrogen atmosphere.

The evaluation results are summarized below:

$ZrO_2$ slurry via corrosion lab (ISTO) as pump spray: separation only possible with tools; slurry "baked" onto sheets; unsuitable.

$Al_2O_3$ solid via corrosion lab (ISTO), ceramics, 99.7% purity: separation only possible with tool; ceramics partly with edge marks from sheets; unsuitable.

Boron Nitride Spray (Spray Henze HeBoCoat 21E):

Sheets separable after annealing, but a 10-20 μm thick molybdenum boride layer forms during annealing; unsuitable.

$ZrO_2$ Spray (Spray from ZYP Coatings Inc. 98% $ZrO_2$, 0.7% MgO, 1.2% $SiO_2$):

The sheets are separable after annealing, but the spray layer is mainly loose on the sheet. Contamination of the plant due to flaking of the $ZrO_2$ spray layer; unsuitable.

$ZrO_2$ Solid 80 μm Ceramic from CeramTec 3YSZ:

The solid sticks to the sheet and the sheets can only be separated with resistance; the solid is very difficult to remove and in some cases cannot be removed completely; unsuitable.

$ZrO_2$ Solid 300 μm Ceramic from CeramTec 5YSZ:

The solid sticks to the sheet and the sheets can only be separated with resistance. The solid is very difficult to remove and in some cases cannot be removed completely, and a an imprint of the solid appears on the opposite side; unsuitable.

$ZrO_2$ Suspension from Sindlhauser Materials Type Zr-W-37:

The suspension shows poor wetting of the sheets in the brush application process. After annealing, the sheets are strongly stuck together in the sandwich and the coating cannot be removed from the coated sheets. In some cases, residues of the coating are found on uncoated sheet sides; unsuitable.

$Y_2O_3$ Suspension from Sindlhauser Materials Type Y-E-32:

The suspension shows good wetting of the sheets in the brush application process. The sheets can be separated well after annealing. There are no residues of the coating on the uncoated sheet sides. Additional microsection analysis showed that there is no surface diffusion into the sheet; suitable.

As can be seen from the above evaluation, some products are not suitable as release agents in high temperature service. Although $ZrO_2$ spray and boron nitride spray are able to maintain sheet releasability, contamination of plants or products occurs because the flaking of the $ZrO_2$ spray layer after high-temperature use requires special cleaning in sintering plants, and boron nitride spray borates the annealed material at the surface. In addition, the use of sprays is only suitable to a limited extent in a production environment with series production.

To the contrary, the use of a layer applied by means of $Y_2O_3$ suspension allows easy separation of Mo sheets annealed at 1900° C. The layer does not flake off the surface of the annealed material. The layer does not flake off the sheets and there is no diffusion of the layer into the surface of the sheets. Therefore, $Y_2O_3$ is excellent as a release agent in high temperature applications.

In another series of experiments, 1 mm molybdenum sheets (area 265 mm×265 mm) were coated on both sides with a $Y_2O_3$ suspension and used for several stacking anneals 1850° C. for 6 h in a hydrogen atmosphere as separator sheets between molybdenum charging sheets (each paired side by side; 2 mm×130 mm×260 mm). For stacking, a Mo—$Y_2O_3$ separator plate was followed by two charging plates placed side by side, followed by a separator plate, and so on. The charging plate layers were rotated alternately by 90° to form a cross-layer structure. The stacks comprised between 20 and 25 charging plate layers. The separator sheets were still operational after 13 applications.

Due to the $Y_2O_3$ layer, sintering of the charging sheets does not occur. The stacked plates could also be separated again without problems after annealing. The $Y_2O_3$ layer adheres stably to the separator plates even after several applications. After heat treatment, the sheets can always be easily separated from each other. Moreover, no negative effects on the base material and the sintering furnace due to contamination were observed. It can be seen that Mo carrier plates with a thin $Y_2O_3$ layer on both sides are very well suited for high-temperature treatments of charging sheets. In particular, the multiple usability of such $Y_2O_3$-coated molybdenum separator plates results in a considerable economic and ecological advantage and over tungsten fines.

The invention claimed is:

1. A component consisting of a metal selected from the group consisting of zirconium, hafnium, vanadium, niobium, tantalum, chromium, molybdenum, tungsten, rhenium, and an alloy of said metals and having a surface at least partially coated with a layer of yttrium oxide, and the component being a threaded component formed with a thread, and wherein the component with the layer of yttrium oxide is temperature-resistant at high temperatures between 1000° C. and 2000° C., and the component remains non-destructively detachable from a screw connection after use at the high temperatures.

2. The component according to claim 1, wherein said alloy comprises at least 70% by weight of molybdenum.

3. The component according to claim 1, wherein the layer of yttrium oxide has a thickness in a range from 10 μm to 150 μm.

4. The component according to claim 1, wherein the surface of the component is completely coated.

5. The component according to claim 1, wherein the surface of the component is only partially coated.

6. A method of manufacturing a component, the method comprising:

providing a component body consisting of a metal selected from the group consisting of zirconium, hafnium, vanadium, niobium, tantalum, chromium, molybdenum, tungsten, rhenium, and an alloy of said metals;

the component being a threaded component and the component body being formed with a thread; and at least partially coating a surface of the component body with a layer of yttrium oxide by slurry coating to render the component temperature-resistant at high temperatures between 1000° C. and 2000° C., and to render the component non-destructively detachable from a screw connection after use at the high temperatures.

* * * * *